US008593120B2

(12) United States Patent
Heng

(10) Patent No.: US 8,593,120 B2
(45) Date of Patent: Nov. 26, 2013

(54) VOLTAGE REGULATOR

(75) Inventor: Socheat Heng, Chiba (JP)

(73) Assignee: Seiko Instruments Inc., Chiba (JP)

( * ) Notice: Subject to any disclaimer, the term of this patent is extended or adjusted under 35 U.S.C. 154(b) by 93 days.

(21) Appl. No.: 13/433,967

(22) Filed: Mar. 29, 2012

(65) Prior Publication Data

US 2012/0249117 A1 Oct. 4, 2012

(30) Foreign Application Priority Data

Mar. 30, 2011 (JP) ..... 2011-075590

(51) Int. Cl.
*G05F 1/569* (2006.01)

(52) U.S. Cl.
USPC ..... 323/276; 323/908; 323/303; 361/93.9

(58) Field of Classification Search
USPC ..... 323/266, 273–276, 279, 281, 299, 303, 323/304, 311, 315, 908; 361/93.9
See application file for complete search history.

(56) References Cited

U.S. PATENT DOCUMENTS

| | | | | |
|---|---|---|---|---|
| 6,348,833 | B1 | 2/2002 | Tsujimoto et al. | |
| 7,068,018 | B2 * | 6/2006 | Kanakubo | 323/274 |
| 7,173,405 | B2 * | 2/2007 | Bo et al. | 323/312 |
| 7,511,464 | B2 * | 3/2009 | Suzuki | 323/275 |
| 7,646,574 | B2 * | 1/2010 | Imura | 361/93.1 |
| 7,772,815 | B2 * | 8/2010 | Okuda et al. | 323/280 |
| 7,969,703 | B2 * | 6/2011 | Tanaka | 361/93.9 |
| 8,233,257 | B2 * | 7/2012 | Hasegawa et al. | 361/93.9 |
| 2012/0249104 | A1 * | 10/2012 | Heng | 323/282 |

* cited by examiner

*Primary Examiner* — Gary L Laxton
*Assistant Examiner* — Kyle J Moody
(74) *Attorney, Agent, or Firm* — Brinks Gilson & Lione

(57) ABSTRACT

A voltage regulator is capable of continuously and smoothly preventing an inrush current independently of a startup characteristic of a reference voltage circuit. The voltage regulator is provided with an inrush current protection circuit composed of a constant-current circuit, a first transistor having the source thereof connected to the constant-current circuit and the gate thereof controlled by an output voltage detection circuit, a capacitor connected between the first transistor and the gate of an output transistor, a second transistor having the gate thereof connected to the drain of the first transistor and the source thereof connected to a power supply terminal, and a third transistor, which is connected between the second transistor and the output transistor and the gate of which is controlled by the output voltage detection circuit.

2 Claims, 3 Drawing Sheets

VOLTAGE REGULATOR

RELATED APPLICATIONS

This application claims priority under 35 U.S.C. §119 to Japanese Patent Application No. 2011-075590 filed on Mar. 30, 2011, the entire content of which is hereby incorporated by reference.

BACKGROUND OF THE INVENTION

1. Field of the Invention

The present invention relates to a voltage regulator provided with an inrush current protection circuit and more particularly to an inrush current protection circuit that controls an inrush current by restricting a fluctuation at the gate of an output driver so as to restrain an inrush current into an output capacitor occurring at a startup.

2. Description of the Related Art

A conventional inrush current protection circuit will be described. FIG. 3 is a circuit diagram of a conventional constant-voltage circuit. The constant-voltage circuit is composed of a constant-voltage source 401 and a soft start circuit, which is an inrush current protection circuit. The soft start circuit has a comparator 404, a delay circuit 412, a constant-current source 407, a capacitor 408, a resistor 403, and switches 402, 410 and 411.

The contact point of the constant-current source 407 and the capacitor 408 is connected to an output terminal 101 of the constant-voltage circuit. The output terminal 101 is connected to a non-inverting input terminal of the comparator 404, and an output terminal of the constant-voltage source 401 is connected to an inverting input terminal of the comparator 404 through the intermediary of an offset voltage 405. An output terminal of the comparator 404 is connected to the switch 402, the constant-current source 407, and the delay circuit 412. An output terminal of the delay circuit 412 is connected to the switch 411.

The capacitor 408 is charged by receiving constant current Ic from the constant-current source 407. The comparator 404 compares the voltage obtained by subtracting the predetermined offset voltage 405 from an output voltage of the constant-voltage source 401 and the voltage at the contact point of the constant-current source 407 and the capacitor 408, and issues an output voltage based on the result of the comparison. The output voltage of the comparator 404 controls the switch 402, the constant-current source 407, and the switch 411 through the delay circuit 412. When the switch 402 is turned on, the capacitor 408 is charged by the constant-voltage source 401 through the resistor 403 on the basis of an RC time constant. After predetermined time elapses since a output voltage is received from the comparator 404, the delay circuit 412 turns the switch 411 on. When the switch 411 is turned on, the output voltage of the constant-voltage source 401 is directly output to the output terminal 101.

The operation of the conventional constant-voltage circuit will now be described. In the state wherein the switch 410 is on, the constant-voltage circuit is not in operation and the output voltage at the output terminal 101 is 0 volt. When the switch 410 is turned off, the constant-voltage circuit is actuated. The constant-current source 407 supplies the constant current Ic to start charging the capacitor 408 with the constant current. At this time, the output voltage at the output terminal 101 linearly rises according to the constant current Ic and the capacitance of the capacitor 408. If the voltage charged in the capacitor 408 exceeds the voltage, which is obtained by subtracting the offset voltage 405 from the voltage of the constant-voltage source 401, then an output signal of the comparator 404 is inverted. This causes the switch 402 to turn on and the constant-current source 407 to stop and the delay circuit 412 to be actuated. When the constant-current source 407 stops its operation, the capacitor 408 is charged with the output voltage of the constant-voltage source 401 through the resistor 403.

The moment the switch 411 turns on after the elapse of the predetermined time since the delay circuit 412 was actuated, the output voltage of the constant-voltage source 401 immediately reaches the output voltage at the output terminal 101. As described above, the output voltage at the output terminal 101 of the constant-voltage circuit gradually increases, thus allowing the output terminal 101 of the constant-voltage circuit to be protected from an inrush current (refer to, for example, FIG. 2 in patent document 1).

[Patent Document 1] Japanese Patent Application Laid-Open No. 2000-56843

However, the conventional art has been posing a problem in that changing from a soft start phase over to a constant-voltage output phase by a switch inconveniently causes discontinuity in a linearly increasing output voltage. There has been another problem in that the need for a comparator and a delay circuit inevitably results in a larger circuit scale.

SUMMARY OF THE INVENTION

The present invention has been made with a view toward the problems described above, and it is an object of the invention to provide a voltage regulator with an inrush current protection circuit which has a small circuit scale and which is capable of achieving a continuous and smooth rise of an output voltage.

A voltage regulator provided with an inrush current protection circuit in accordance with the present invention includes: a reference voltage circuit which outputs a reference voltage; an output transistor; a first differential amplifier circuit which amplifies and outputs the difference between the reference voltage and a divided voltage obtained by dividing a voltage output from the output transistor and controls a gate of the output transistor; an inrush current protection circuit which controls a gate voltage of the output transistor to prevent an inrush current; and an output voltage detection circuit which controls the inrush current protection circuit, wherein the inrush current protection circuit includes: a constant-current circuit having one end thereof connected to a power supply terminal; a first transistor having a source thereof connected to the other end of the constant-current circuit and a gate thereof controlled by the output voltage detection circuit; a capacitor having one end thereof connected to a drain of the first transistor and the other end thereof connected to the gate of the output transistor; a second transistor having a gate thereof connected to the source of the first transistor and a source thereof connected to a power supply terminal; and a third transistor having a drain thereof connected to the gate of the output transistor, a source thereof connected to a drain of the second transistor and a gate thereof controlled by the output voltage detection circuit.

The voltage regulator provided with the inrush current protection circuit in accordance with the present invention does not use any switches, thus making it possible to continuously restrain an inrush current. In addition, the voltage regulator does not involve self-consumption current, so that a reduced circuit scale can be achieved.

DETAILED DESCRIPTION OF THE PREFERRED EMBODIMENTS

Embodiments of the present invention will be described with reference to the accompanying drawings.

First Embodiment

Figure 1:
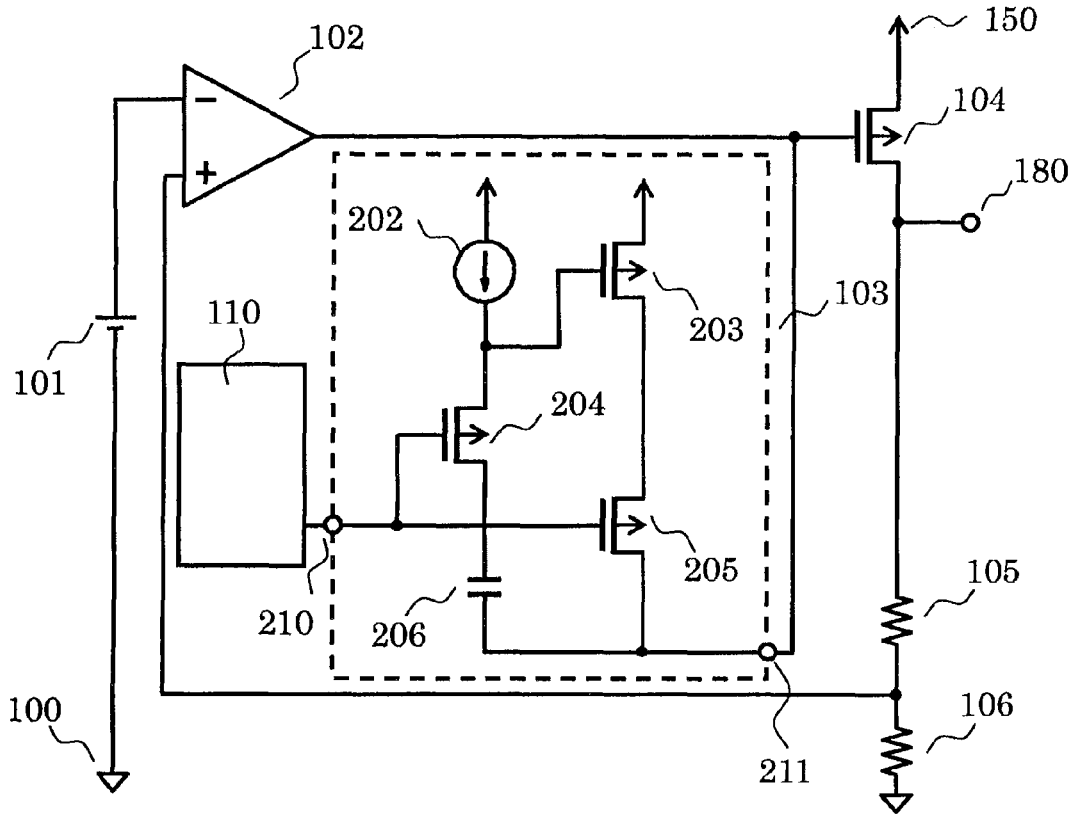
FIG. 1 is a circuit diagram of a voltage regulator according to a first embodiment.

FIG. 1 is a circuit diagram of a voltage regulator according to a first embodiment. The voltage regulator according to the first embodiment is constituted of a reference voltage circuit 101, a differential amplifier circuit 102, a PMOS transistor 104, resistors 105 and 106, an inrush current protection circuit 103, an output voltage detection circuit 110, a power supply terminal 150, a ground terminal 100, and an output terminal 180. The inrush current protection circuit 103 is constituted of an input terminal 210, an output terminal 211, PMOS transistors 203, 204 and 205, a constant-current circuit 202, and a capacitor 206.

The inverting input terminal of the differential amplifier circuit 102 is connected to the reference voltage circuit 101, while the non-inverting input terminal thereof is connected to the connection point of the resistors 105 and 106, and the output terminal thereof is connected to the gate of the PMOS transistor 104 and an output terminal 211 of the inrush current protection circuit 103. The other end of the reference voltage circuit 101 is connected to a ground terminal 100. The source of the PMOS transistor 104 is connected to the power supply terminal 150 and the drain thereof is connected to the output terminal 180 and the other end of the resistor 105. The other end of the resistor 106 is connected to the ground terminal 100. The gate of the PMOS transistor 204 is connected to an input terminal 210 of the inrush current protection circuit 103 and the gate of the PMOS transistor 205, the source thereof is connected to the constant-current circuit 202 and the gate of the PMOS transistor 203, and the drain thereof is connected to the capacitor 206. The other end of the constant-current circuit 202 is connected to the power supply terminal 150. The source of the PMOS transistor 205 is connected to the drain of the PMOS transistor 203, and the drain thereof is connected to the other end of the capacitor 206 and the output terminal 211 of the inrush current protection circuit 103. The source of the PMOS transistor 203 is connected to the power supply terminal 150. The input terminal 210 is connected to the output voltage detection circuit 110.

The operation of the voltage regulator according to the present embodiment will now be described.

The resistors 105 and 106 divide an output voltage Vout, which is the voltage of the output terminal 180, and output a divided voltage Vfb. The differential amplifier circuit 102 compares an output voltage Vref of the reference voltage circuit 101 with the divided voltage Vfb to control the gate voltage of the PMOS transistor 104 such that the output voltage Vout remains constant. If the output voltage Vout is higher than a desired value, then the divided voltage Vfb will be higher than the reference voltage Vref and the output signal of the differential amplifier circuit 102 (the gate voltage of the PMOS transistor 104) will become high. Further, the PMOS transistor 104 turns off, causing the output voltage Vout to be lower. Thus, the output voltage Vout is controlled to remain at a constant level. If the output voltage Vout is lower than the desired value, then a reverse operation from the above is performed to increase the output voltage Vout. In this manner, the output voltage Vout is controlled to remain at the constant level.

The operation at the startup of the supply voltage of the voltage regulator according to the present embodiment will now be described.

When the differential amplifier circuit 102 detects that the output voltage Vout is low, it controls the gate voltage such that the PMOS transistor 104 turns on. The output voltage detection circuit 110 outputs a Lo signal to the terminal 210 of the inrush current protection circuit 103. In the inrush current protection circuit 103, the PMOS transistors 204 and 205 turn on. When the PMOS transistor 204 turns on, the gate voltage of the PMOS transistor 203 becomes low, causing the PMOS transistor 203 to turn on. The PMOS transistor 203 and the PMOS transistor 205 turn on, so that the gate voltage is controlled such that the PMOS transistor 104 turns off. The currents from the PMOS transistor 203 and the PMOS transistor 205 are designed to be smaller than the current from a transistor in an output stage of the differential amplifier circuit 102. Hence, the PMOS transistor 203 and the PMOS transistor 205 function to prevent the differential amplifier circuit 102 from excessively turning the PMOS transistor 104 on. Thus, the inrush current protection circuit 103 restrains the inrush current of the output terminal 180.

When the supply voltage is started to increase, the amount of a transient fluctuation at the gate of the PMOS transistor 104 changes according to a stabilizing capacitance or load current condition. Hence, as the amount of the fluctuation increases, the amount of fluctuation in the gate voltage of the PMOS transistor 203 with respect to the supply voltage increases and the operation for returning the gate voltage of the PMOS transistor 104 to the supply voltage is enhanced accordingly. Inversely, as the amount of the fluctuation decreases, the amount of fluctuation in the gate voltage of the PMOS transistor 203 with respect to the supply voltage decreases and the operation on the gate of the PMOS transistor 104 is hardly carried out. Thus, a prompt startup can be achieved by restraining the inrush current to a minimum according to a stabilizing capacitance or a load current.

After the rise of the output voltage, a Hi signal is output from the output voltage detection circuit 110, causing the voltage at the input terminal 210 to become high. This turns the PMOS transistors 204 and 205 off, stopping the operation of the inrush current protection circuit 103. Thus, malfunctions can be prevented in a normal operation, permitting reduced power consumption.

As described above, the voltage regulator according to the first embodiment is capable of preventing an inrush current at the time of turning the power on and achieving a prompt startup.

Second Embodiment

Figure 2:
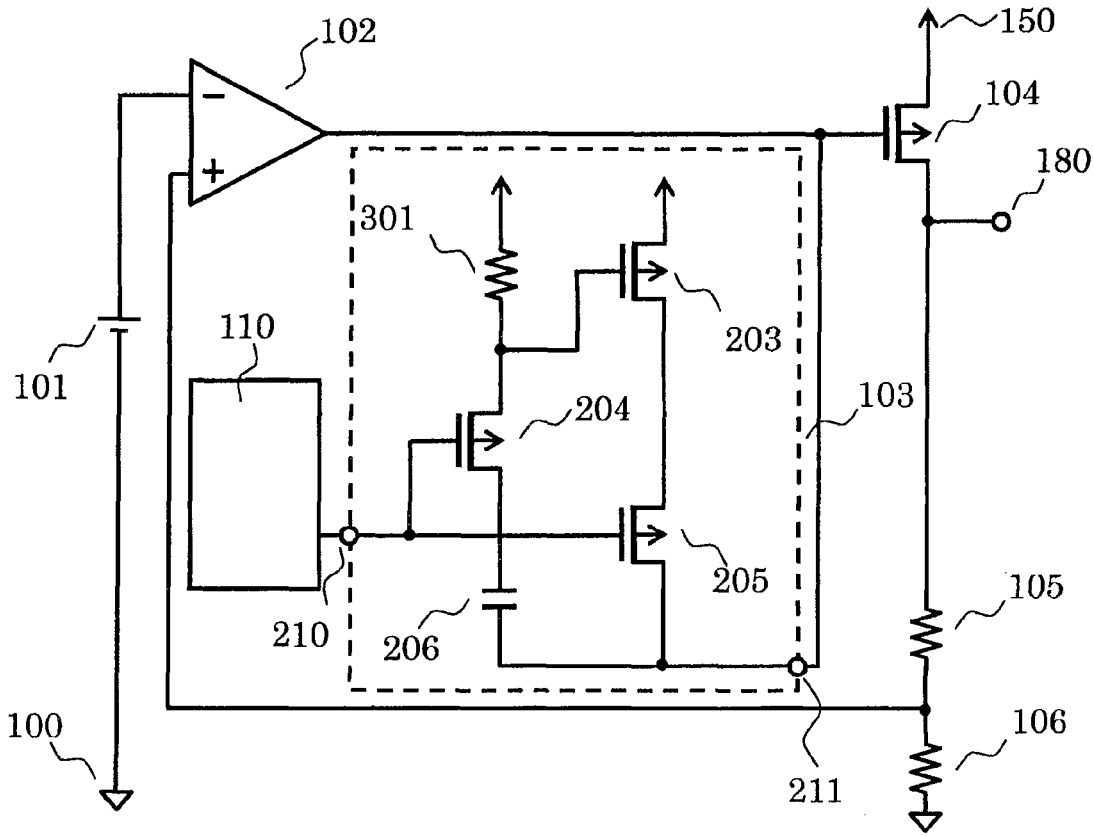
FIG. 2 is a circuit diagram of a voltage regulator according to a second embodiment.
Figure 3:
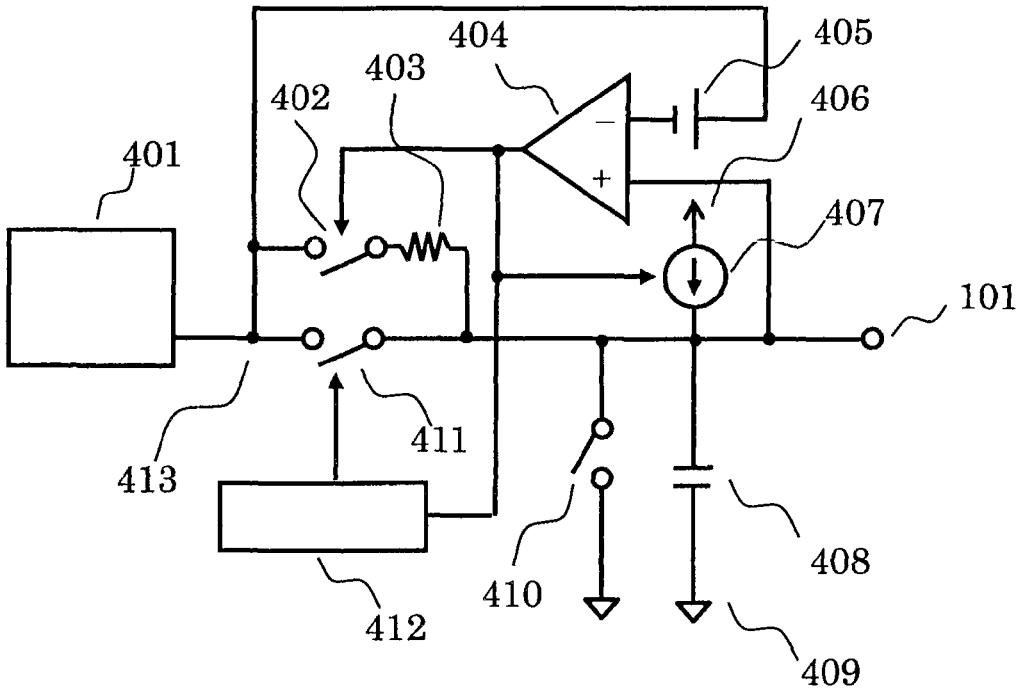
FIG. 3 PRIOR ART
FIG. 3 is a circuit diagram of a conventional voltage regulator.

FIG. 2 is a circuit diagram of a voltage regulator according to a second embodiment. This voltage regulator differs from the one illustrated in FIG. 1 in that the constant-current circuit 202 has been replaced by a resistor 301. The configuration also enables the voltage regulator to be operated in the same manner as the voltage regulator according to the first embodiment.

What is claimed is:

1. A voltage regulator comprising:

a reference voltage circuit which outputs a reference voltage;

an output transistor;

a first differential amplifier circuit which amplifies and outputs a difference between the reference voltage and a divided voltage obtained by dividing a voltage output from the output transistor and controls a gate of the output transistor;

an inrush current protection circuit which controls a gate voltage of the output transistor to prevent an inrush current;

and an output voltage detection circuit which controls the inrush current protection circuit, wherein the inrush current protection circuit comprises:

a constant-current circuit having one end thereof connected to a power supply terminal;

a first transistor having a source thereof connected to the other end of the constant-current circuit and a gate thereof controlled by the output voltage detection circuit;

a capacitor having one end thereof connected to a drain of the first transistor and the other end thereof connected to the gate of the output transistor;

a second transistor having a gate thereof connected to the source of the first transistor and a source thereof connected to the power supply terminal;

and a third transistor having a drain thereof connected to the gate of the output transistor, a source thereof connected to a drain of the second transistor and a gate thereof controlled by the output voltage detection circuit.

2. A voltage regulator according to claim 1, wherein the constant-current circuit is composed of a resistor.

* * * * *